United States Patent [19]

Masaki et al.

[11] Patent Number: 4,886,724

[45] Date of Patent: Dec. 12, 1989

[54] PHOTOSENSITIVE MEMBER HAVING AN OVERCOAT LAYER AND PROCESS FOR MANUFACTURING THE SAME

[75] Inventors: Kenji Masaki; Izumi Osawa; Masanori Fujiwara; Isao Doi; Yumiko Takedomi, all of Osaka, Japan

[73] Assignee: Minolta Camera Kabushiki Kaisha, Osaka, Japan

[21] Appl. No.: 164,891

[22] Filed: Mar. 7, 1988

[30] Foreign Application Priority Data

| | | | |
|---|---|---|---|
| Mar. 9, 1987 | [JP] | Japan | 62-53628 |
| Mar. 9, 1987 | [JP] | Japan | 62-53629 |
| Mar. 9, 1987 | [JP] | Japan | 62-53630 |
| Mar. 9, 1987 | [JP] | Japan | 62-53631 |

[51] Int. Cl.[4] ..... G03G 5/14

[52] U.S. Cl. ..... 430/66; 430/132

[58] Field of Search ..... 430/57, 58, 66, 132

[56] References Cited

U.S. PATENT DOCUMENTS

| | | | |
|---|---|---|---|
| 3,956,525 | 5/1986 | Yasuba | 427/41 |
| 4,366,208 | 12/1982 | Akai et al. | 428/421 |
| 4,394,425 | 7/1983 | Shimizu et al. | 430/65 |
| 4,490,450 | 12/1984 | Shimizu et al. | 430/57 |
| 4,544,617 | 10/1985 | Mort et al. | 430/58 |
| 4,749,636 | 6/1988 | Iino et al. | 430/58 |
| 4,755,444 | 7/1988 | Karakida et al. | 430/66 |
| 4,770,966 | 9/1988 | Kazama et al. | 430/66 |
| 4,774,130 | 9/1988 | Endo et al. | 428/216 |

FOREIGN PATENT DOCUMENTS

| | | |
|---|---|---|
| 50-30526 | 3/1974 | Japan . |
| 51-46130 | 4/1976 | Japan . |
| 55-86169 | 6/1980 | Japan . |
| 56-62254 | 5/1981 | Japan . |
| 57-64239 | 4/1982 | Japan . |
| 58-139154 | 8/1983 | Japan . |
| 50-136742 | 8/1984 | Japan . |
| 59-214859 | 12/1984 | Japan . |
| 60-61761 | 4/1985 | Japan . |
| 60-101541 | 6/1985 | Japan . |
| 60-249155 | 12/1985 | Japan . |
| 61-94056 | 5/1986 | Japan . |
| 61-289355 | 12/1986 | Japan . |
| 1174171 | 12/1969 | United Kingdom . |

OTHER PUBLICATIONS

"Formation of an Amorphous Powder During the Polymerization of Ethylene in a Radio-Frequency Discharge", *Journal of Applied Polymer Science,* vol. 17, 1973, New York.

A. Dilkes S. Kaplan, and A. Vanlaeken, "A C-NMR Investigation of Plasma Polymerized Ethane, Ethylene, and Acetylene", Xerox Webster Research Center.

W. E. Spear and P. G. Le Comber, "Electronic Properties of Substitutionally Doped Amorphous Si and Ge", Philosophical Magazine, 1976, vol. 33, No. 6,935-949.

"Photosensitive Materials for Electron Photography—OPC vs. Inorganics", Nikkei New Materials, Dec. 15, 1986.

John A. Woolam et al., "Optical and Interfacial Electronic Properties of Diamond-Like Carbon Films".

Mitchell Shen and Alexis T. Bell, "A Review of Recent Advances in Plasma Engineering", Review of Recent Advances, Mar. 29, 1979.

*Primary Examiner*—John L. Goodrow

*Attorney, Agent, or Firm*—Burns, Doane, Swecker & Mathis

[57] ABSTRACT

A photosensitive member of the present invention comprises an electrically conductive substrate, a photosensitive layer comprising an organic material and a hydrogen-containing amorphous carbon overcoat layer containing one or more elements selected from the group consisting of chalcogen and elements in Group III, IV and V of the periodic table.

The overcoat layer contains hydrogen in an amount of about 30 to about 60 atomic % based on the combined amount of hydrogen atoms and carbon atoms.

11 Claims, 3 Drawing Sheets

PHOTOSENSITIVE MEMBER HAVING AN OVERCOAT LAYER AND PROCESS FOR MANUFACTURING THE SAME

BACKGROUND OF THE INVENTION

1. Field of the Invention:

The present invention relates to a photosensitive member comprising an overcoat layer on a photosensitive layer of organic materials.

2. Description of the Prior Art:

Remarkable progress has been made in the application of electrophotographic techniques since the invention of the Carlson process. Various materials have also been developed for use in electrophotographic photosensitive members.

Organic materials used for the construction of electrophotographic photosensitive members are well known to those skilled in the art (for example, the materials disclosed in the Dec. 15, 1986 issue of Nikkei New Materials, pages 83–98), and these materials have made superior photosensitive members practical from the standpoints of sensitivity, chargeability and construction costs.

Materials used in the construction of organic photosensitive members are, in general, photoconductive materials which produce an electric charge such as, for example, phthalocyanine series pigments, azo series pigments, perillene series pigments and the like, electrical charge transporting materials such as, for example, triphenylmethanes, triphenylamines, hydrazones, styryl compounds, pyrazolines, oxazoles, oxydiazoles, and the like, binding materials for dispersion coating such as, for example, polyester, polyvinyl butyral, polycarbonate, polyarylate, phenoxy, styrene-acryl, and other resins.

Repeated use of these types of photosensitive members, however, gives rise to problems of image defects, white streaks, and the like These problems arise because the surface hardness of the organic photosensitive member roughly falls within the range from the 5 B to B levels of the JIS standards for pencil lead hardness, thus the surface of the photosensitive member is readily damaged due to the friction which is generated when the member comes into contact with the transfer paper, cleaning components, developer, and the like. Another cause of such problems is the harsh surface contact made when paper jams occur and the resultant reversion to manual operation required to remedy the malfunction. Furthermore, damage to the surface of the photosensitive member results in a marked reduction in the surface potential of the member.

In order to eliminate these disadvantages, it is proposed that the surface of the photosensitive member be covered with a protective layer.

The technology described in U.S. Pat. No. 3,956,525 discloses a photosensitive member of the polyvinylcarbazole-selenium type coated with a polymer film having a thickness of 0.1 to 1 microns and formed by glow discharge polymerization as a protective layer.

The technology described in Unexamined Japanese Patent Publication SHO No. 60-61761 discloses a photosensitive member comprising a photactive layer covered by a diamond carbon layer.

The technology described in U.S. Pat. No. 4,544,617 discloses a photosensitive member comprising an amorphous silicon carrier generation and transport layer, trapping layer doped with boron or phosphorous, and an overcoating layer comprised of silicon nitride, silicon carbide or amorphous carbon.

Although the aforementioned manufacturing process disclosed in U.S. Pat. No. 3,956,525 improves the solvent resistance of the photosensitive member, moisture and friction resistances are inadequate, which gives rise to the disadvantages of image drift and cutting Furthermore, there is no suggestion in the disclosure concerning the improvement of the disadvantages.

The photosensitive member disclosed in Unexamined Japanese Patent Publication SHO No. 60-61761 also has the disadvantages of poor moisture resistance and readily producing image drift.

On the other hand, most organic photosensitive members are poor in terms of heat resistance, that is to say, photosensitivity is reduced when such a member is subjected to a excessive high-temperature heating during the process for providing a protective overcoat layer. The technology disclosed in the aforementioned Unexamined Japanese Patent Publication SHO No. 60-61761 suggests a process for the manufacture of a photoactive layer wherein a diamond carbon layer is successively formed on an amorphous silicon layer normally manufactured at 150° to 300° C. When this process is used on an organic photosensitive member, however, it presents the disadvantage in that the photosensitivity of said member is completely lost.

The photosensitive member disclosed in the aforesaid U.S. Pat. No. 4,544,617 also has poor moisture resistance which has the disadvantage of leading to the production of image drift. This process cannot be applied to the organic photosensitive members because the substrate is subjected to high temperatures during the overcoat layer formation process.

An organic photosensitive member has a relatively soft and easily damaged surface and does not possess an overcoating protective layer which is effective in preventing the production of image drift during long-term use.

SUMMARY OF THE INVENTION

The main object of the present invention is to provide a photosensitive member the surface of which will not be damaged with repeated use and which has superior resistance to environmental factors.

Another object of the invention is to provide a photosensitive member which will not give rise to image drift.

Still another object of the invention is to provide a photosensitive member having an overcoat layer which will not peel off due to mechanical contact or fluctuations in moisture or temperature when used in a copying machine.

A still further object of the invention is to provide a process for the manufacture of a photosensitive member having an organic photosensitive layer and a protective overcoat layer formed thereon without harm to the sensitivity characteristics of the organic photosensitive layer.

These and other objects of the invention can be accomplished by providing a photosensitive member comprising an electrically conductive substrate, a photosensitive layer formed of organic material and an overcoat layer formed on the photosensitive layer and comprising amorphous carbon containing hydrogen and one or more elements selected from the group consisting of chalcogen and elements in Group III, IV and V of the periodic table.

BRIEF DESCRIPTION OF THE DRAWINGS

In the following description, like parts are designated by like reference numbers throughout the several drawings.

FIGS. 7 and 8 are diagrams showing apparatus for preparing photosensitive members of the invention.

DETAILED DESCRIPTION OF THE PREFERRED EMBODIMENTS

Figure 1:
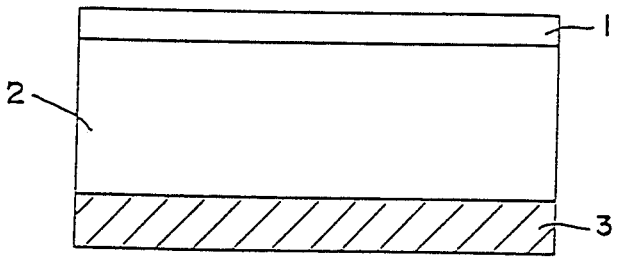
FIG. 1 is a diagram showing a photosensitive member embodying the invention.

FIG. 1 shows an example of the construction of a photosensitive member of the present invention wherein a conductive substrate 3 has sequentially laminated thereon a photosensitive layer 2 and an overcoat layer 1 formed of an amorphous hydrocarbon layer.

A photosensitive layer 2 is provided on a conductive substrate 3 thereby forming an organic photosensitive member, and the interior construction of said photosensitive layer 2 may be a functionally separated construction having a laminated charge producing layer and a charge transporting layer, a binder-type construction having a charge producing material and charge transporting material dispersed throughout a binding material, or other construction.

The conductive substrate 3 may be at a minimum a material which is conductive on its outermost surface, and may be cylindrical, flexible belt, flat plate, or other arbitrary shape.

The characteristics of the present invention is an overcoat layer 1 having at least one or more elements selected from the group of chalcogen and elements in Group III, IV and V of the periodic table in an amorphous carbon layer (hereinafter referred to as an a-C layer).

The amorphous carbon layer itself has a hardness rating of 4 H, but becomes harder and damage resistant by means of the addition of at least one or more elements selected from the group of chalcogen and elements in Group III, IV and V of the periodic table, the addition of said atoms providing an overcoat layer 1 which has comparatively superior moisture resistance, assures suitable chargeability, and has superior transparency to light.

The amounts of chalcogen atoms and elements in Group III and V of the periodic table to be present in the a-C layer of the present invention is preferably from about 0.1 atomic % to 20 atomic %, more preferably from about 0.5 atomic % to 20 atomic %, and most preferably from about 1.0 atomic % to 20 atomic % based on all the constituent atoms of the a-C layer.

The amount of elements in Group IV of the periodic table to be present in the a-C layer of the present invention is preferably about 0.1 to 50 atomic %, more preferably about 0.5 to 30 atomic %, and most preferably about 1.0 to 20 atomic % based on all the constituent atoms of the a-C layer.

The content of less than 0.1 atomic % of these atoms is undesirable in view of moisture resistance If the amount of IV atoms of the periodic table exceeds 50 atomic % based on all the constituent atoms of the a-C layer, the coefficient of light absorption increases Therefore, the irradiating light cannot effectively be introduced into the organic photosensitive layer to cause reduction of photosensitivity.

Although there is no particular limitation on the amount of the above-mentioned atoms which may be contained in the a-C layer, the amount is necessarily restricted from the perspectives of the overcoat layer manufacturing and glow discharge processes.

Although there is no particular limitation on the amount of the hydrogen atoms which may be contained in the a-C layer, the amount is necessarily restricted from the perspectives of the overcoat layer manufacturing and glow discharge processes, said amount being, in general, 30 to 60 atomic %.

The contents of these atoms in the a-C layer can be determined by a usual method of elementary analysis, e.g. Auger electron spectroscopy or IMA analysis. The a-C layer may contain chalcogen atoms and elements in Group III, IV and V of the periodic table singly, and may contain two or more of the above types of atoms.

The overcoat layer 1 of the present invention is formed at a thickness of 0.01 to 5 microns, preferably 0.05 to 2 microns, and ideally 0.1 to 1 microns. A layer with a thickness of less than 0.01 micron has reduced hardness and is readily damaged. Also, a layer with the thickness exceeding 5 microns has reduced transparency to light and causes reduced sensitivity of the photosensitive member because the exposed light cannot be effectively conducted to the organic photosensitive layer.

The overcoat layer 1 of the photosensitive member of the present invention may be formed on an organic photosensitive member, thus achieving the objects of the present invention.

The overcoat layer 1 is formed by means of a glow discharge process. The overcoat layer 1 is formed by discharging at reduced pressure gaseous-phase molecules containing at least carbon atoms and molecules containing hydrogen atoms together with molecules containing at least one or more elements selected from the group consisting of chalcogen and elements in Group III, IV and V, thereby diffusing on the substrate the activated neutral atoms and charged atoms in the plasma production region, and being induced by electrical or magnetic force or the like to form on the substrate in solid phase via a recombination reaction. The formation of the overcoat layer 1 can be regulated via the aforesaid plasma reaction (hereinafter referred to as a P-CVD reaction) to form an amorphous hydrocarbon layer incorporating at least one or more elements selected from the group consisting of chalcogen and elements in Group III, IV and V of the periodic table.

These hydrocarbons need not always be in a gaseous phase at room temperature at atmospheric pressure but can be in a liquid or solid phase insofar as they can be vaporized on melting, evaporation or sublimation, for example, by heating or in a vacuum. Examples of useful hydrocarbons are saturated hydrocarbons, unsaturated hydrocarbons, alicyclic hydrocarbons, aromatic hydrocarbons and the like. Such hydrocarbons are usable in combination.

A wide variety of hydrocarbons are usable. Examples of useful saturated hydrocarbons are normal paraffins such as methane, ethane, propane, butane, pentane, hexane, heptane, octane, nonane, decane, undecane, dodecane, tridecane, tetradecane, pentadecane, hexadecane, heptadecane, octadecane, nonadecane, eicosane, heneicosane, docosane, tricosane, tetracosane, pentacosane, hexacosane, heptacosane, octacosane, nonacosane, triacontane, dotriacontane, pentatriacontane, etc.; isoparaffins such as isobutane, isopentane, neopentane, isohexane, neohexane, 2,3-dimethylbutane, 2-methylhexane, 3-ethylpentane, 2,2-dimethylpentane, 2,4-dimethylpentane, 3,3-dimethylpentane, tributane, 2-methylheptane, 3-methylheptane, 2,2-dimethylhexane, 2,2,5-dimethylhexane, 2,2,3-trimethylpentane, 2,2,4-trimethylpentane, 2,3,3-trimethylpentane, 2,3,4-trimethylpentane, isononane, etc.; and the like.

Examples of useful unsaturated hydrocarbons are olefins such as ethylene, propylene, isobutylene, 1-butene, 2-butene, 1-pentene, 2-pentene, 2-methyl-1-butene, 3-methyl-1-butene, 2-methyl-2-butene, 1-hexene, tetramethylethylene, 1-heptene, 1-heptene, 1-octene, 1-nonene, 1-decene and the like; diolefins such as allene, methyl-allene, butadiene, pentadiene, hexadiene, cyclopentadiene and the like; triolefins such as ocimene, alloocimene, myrcene, hexatriene and the like; acetylene, methylacetylene, 1-butyne, 2-butyne, 1-pentyne, 1-hexyne, 1-heptyne, 1-octyne, 1-nonyne, 1-decyne, butadyine and the like.

Examples of useful alicyclic hydrocarbons are cycloparaffins such as cyclopropane, cyclobutane, cyclopentane, cyclohexane, cycloheptane, cyclooctane, cyclononane, cyclodecane, cycloundecane, cyclodoecane, cyclotridecane, cyclotetradecane, cyclopentadecane, cyclohexadecane and the like; cycloolefins such as cyclopropene, cyclobutene, cyclopentene, cyclohexene, cycloheptene, cyclooctene, cyclononene, cyclodecene and the like; terpenes such as limonene, terpinolene, phellandrene, sylvestrene, thujene, carene, pinene, bornylene, camphene, fenchene, cyclofenchene, tricyclene, bisabolene, zingiberene, curcumene, humulene, cadinenesesquibenihene, selinene, caryophyllene, santalene, cedrene, camphorene, phyllocladene, podocarprene, mirene and the like; steroids; etc.

Examples of useful aromatic hydrocarbons are benzene, toluene, xylene, hemimellitene, pseudocumene, mesitylene, prehnitene, isodurene, durene, pentamethylbenzene, hexamethylbenzene, ethylbenzene, propylbenzene, cumene, styrene, biphenyl, terphenyl, diphenylmethane, triphenylmethane, dibenzyl, stilbene, indene, naphthalene, tetralin, anthracene, phenanthrene and the like.

The hydrogen content of the a-C layer of the invention is variable in accordance with the film forming apparatus and film forming conditions. The hydrogen content can be decreased, for example, by elevating the substrate temperature, lowering the pressure, reducing the degree of dilution of the starting materials, applying a greater power, decreasing the frequency of the alternating electric field to be set up, increasing the intensity of a d.c. electric field superposed on the alternating electric field or desired combination of such procedures.

Examples of molecules containing at least chalcogen atoms are $H_2S$, $CH_3(CH_2)_4S(CH_2)_4CH_3$, $CH_2{=}CHCH_2SCH_2CH{=}CH_2$, $C_2H_5SC_2H_5$, $C_2H_5SCH_3$, thiophene, $H_2Se$, $(C_2H_5)_2Se$, $H_2Te$ and the like.

Examples of molecules containing at least Group III elements of the periodic table are $B_2H_6$, $BCl_3$, $BBr_3$, $BF_3$, $B(OC_2H_5)_3$, $AlCl_3$, $Al(Oi\text{-}C_3H_7)_3$, $(CH_3)_3Al$, $(C_2H_5)_3Al$, $(i\text{-}C_4H_8)_3Al$, $GaCl_3$, $GaBr_3$, $Ga(Oi\text{-}C_3H_7)_3$, $(CH_3)_3Ga$, $(C_2H_5)_3Ga$, $In(Oi\text{-}C_3H_7)_3$, $(C_2H_5)_3In$ and the like.

Examples of molecules containing at least Group IV element of the periodic table are $SiH_4$, $Si_2H_6$, $(C_2H_5)_3SiH$, $SiF_4$, $SiH_2Cl_2$, $SiCl_4$, $Si(OCH_3)_4$, $Si(OC_2H_5)_4$, $Si(OC_3H_7)_4$, $GeH_4$, $GeCl_4$, $GeF_4$, $Ge_2H_6$, $Ge(OC_2H_5)_4$, $Ge(C_2H_5)_4$, $(CH_3)_4Sn$, $(C_2H_5)_4Sn$, $SnCl_4$ and the like.

Examples of molecules containing at least Group V elements of the periodic table are $PH_3$, $PF_3$, $PF_5$, $PCl_2F$, $PCl_2F_3$, $PCl_3$, $PBr_3$, $PO(OCH_3)_3$, $P(C_2H_5)_3$, $POCl_3$, $AsH_3$, $AsCl_3$, $AsBr_3$, $AsF_3$, $AsF_5$, $AsCl_3$, $SbH_3$, $SbF_3$, $SbCl_3$, $Sb(OC_2H_5)_3$ and the like.

The amount of these atoms, i.e., chalcogen atoms and III, IV and V atoms of the periodic table, incorporated in the a-C layer can be regulated at least by means of increasing or decreasing the amount of molecules containing these atoms in the P-CVD reaction.

Figure 2:
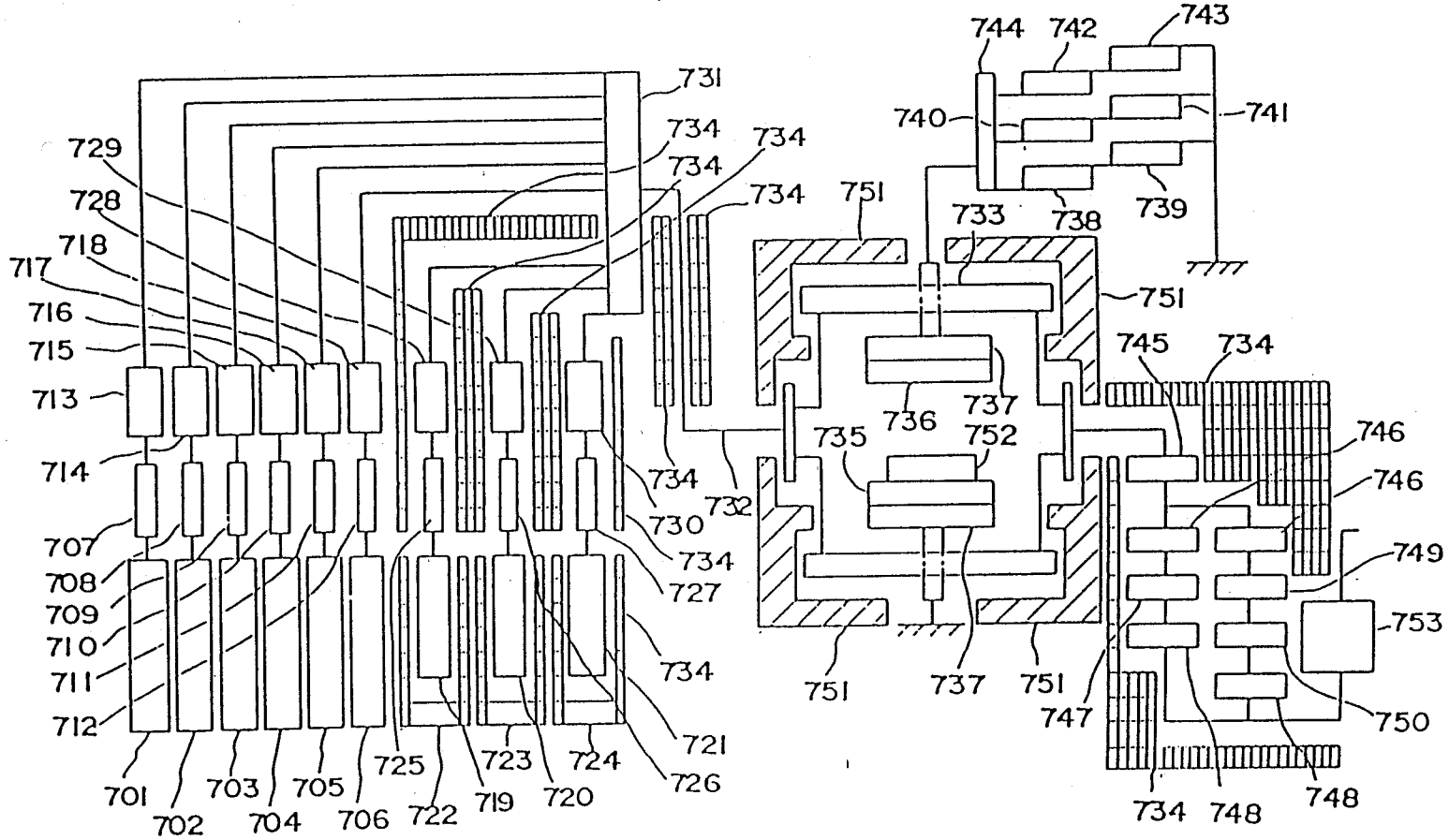
Figure 3:
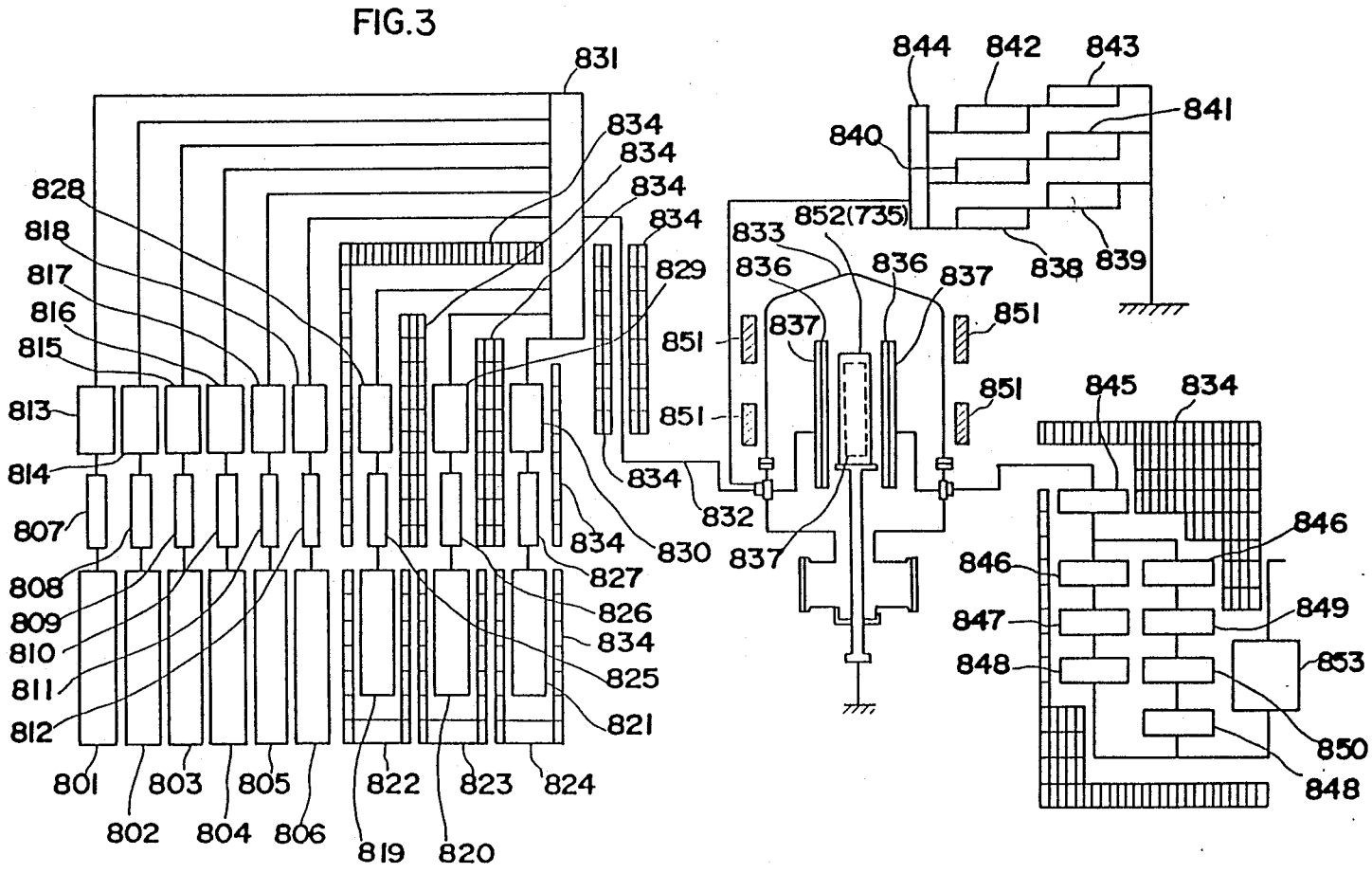

FIGS. 2 and 3 show single examples of a glow discharge decomposition apparatus for forming the overcoat layer of the present invention. FIG. 2 shows a plane-parallel plate P-CVD apparatus and FIG. 3 shows a cylindrical P-CVD apparatus.

First, an explanation of the apparatus shown in FIG. 2 follows hereinafter.

FIG. 2 shows an apparatus for preparing the photosensitive member of the invention. First to sixth tanks 701 to 706 have enclosed therein starting material compounds which are in gas phase at room temperature and a carrier gas and are connected respectively to first to sixth regulator valves 707 to 712 and first to sixth flow controllers 713 to 718. First to third containers 719 to 721 contain starting material compounds which are liquid or solid at room temperature, can be preheated by first to third heaters 722 to 724 for vaporizing the compounds, and are connected to seventh to ninth regulator valves 725 to 727 and seventh to ninth flow controllers 728 to 730, respectively. The gases to be used as selected from among these gases are mixed together by a mixer 731 and fed to a reactor 733 via a main pipe 732. The interconnecting piping can be heated by a pipe heater 734 which is suitably disposed so that the material compound, in a liquid or solid phase at room temperature and vaporized by preheating, will not condense during transport. A grounded electrode 735 and a power application electrode 736 are arranged as opposed to each other within the reactor 733. Each of these electrodes can be heated by an electrode heater 737. The power application electrode 736 is connected to a high-frequency power source 739 via a high-frequency power matching device 738, to a low-frequency power source 741 via a low-frequency power matching device 740 and to a d.c. power source 743 via a low-pass filter 742. Power of one of the different frequencies is applicable to the electrode 736 by way of a connection selecting switch 744. The internal pressure of the reactor 733 is adjustable by a pressure control valve 745. The reactor 733 is evacuated by a diffusion pump 747 and an oil rotary pump 748 via an exhaust system selecting valve 746, or by a cooling-removing device 749, a mechanical booster pump 750 and an oil rotary pump 748 via another exhaust system selecting value 746. The exhaust gas is further made harmless by a suitable removal device 753 and then released to the atmosphere. The evacuation piping system can also be heated by a suitably disposed pipe heater 734 so that the material compound which is liquid or solid at room temperature and vaporized by preheating will not condense during transport. For the same reason, the reactor 733 can also be heated by a reactor heater 751. An electrically conductive substrate 752 is placed on the electrode 735 in the reactor. Although FIG. 2 shows that, the substrate 752 is fixed to the grounded electrode 735, the substrate may be attached to the power application electrode 736, or to both the electrodes.

FIG. 3 shows another type of apparatus for preparing the photosensitive member of the invention. This apparatus has the same construction as the apparatus of FIG. 2 with the exception of the interior arrangement of the reactor 833. The numerals shown by 700 order in FIG. 2 are replaced by the numerals at 800 order in FIG. 8. With reference to FIG. 3, the reactor 833 is internally provided with a hollow cylindrical electrically conductive substrate 852 serving also as the rounded electrode 735 of FIG. 2 and with an electrode heater 837 inside thereof. A power application electrode 836, similarly in the form of a hollow cylinder, is provided around the substrate 852 and surrounded by an electrode heater 837. The conductive substrate 852 is rotatable about its own axis by motor from outside.

The reactors shown in FIGS. 2 and 3 for preparing the photosensitive member are first evacuated by the diffusion pump to a vacuum of about $10^{-4}$ to about $10^{-6}$ torr, whereby the adsorbed gas inside the reactor is removed. The reactor is also checked for the degree of vacuum. At the same time, the electrodes and the substrate fixedly placed on the electrode are heated to a predetermined temperature. In order to prevent heat conversion of the organic photosensitive layer at this time, it is desirable that the substrate temperature be set at 100° C. or less (room temperature to 100° C.). A photosensitive member comprising a conductive substrate having a photosensitive layer provided thereon may be used.

Subsequently, material gases are fed into the reactor from the first to sixth tanks and the first to third containers (i.e. from those concerned), each at a specified flow rate, using the flow controllers concerned, i.e. first to ninth flow controllers and the interior of the reactor is maintained in a predetermined vacuum by the pressure control valve. After the combined flow of gases has become stabilized, the high-frequency power source, for example, is selected by the connection selecting switch to apply a low-frequency power to the power application electrode. This initiates discharge across the two electrodes, forming a solid layer on the substrate with time. The thickness of the layer is controllable by varying the reaction time, such that the discharge is discontinued upon the thickness reaching the desired value. Consequently, the a-C layer of the invention is obtained which serves as an overcoat layer.

The present invention will be described with reference to the following examples.

First, the organic photosensitive layers A through E were manufactured. Hereafter, photosensitive layers formed on an aluminum plate substrate measuring 50 mm in length, 50 mm in width and 3 mm in thickness have the supplementary designation "p" and are thus labeled organic photosensitive layers Ap to Ep, and likewise, photosensitive layers formed on a cylindrical aluminum substrate measuring 80 mm in diameter and 330 mm in length have the supplementary designation "d" and are thus labeled organic photosensitive layers Ad to Ed.

Manufacture of Organic Photosensitive Layer A

A fluid mixture of 1 g of chlorodian blue (CDB) as a disazo pigment, 1 g of polyester resin (Toyobo Co., LTD., V-200), and 98 g of cyclohexanone are dispersed in a sand grinder for 13 hours. An aluminum plate substrate measuring 50×50×3 mm is dipped in the fluid dispersion so as to be coated with a 0.3 micron thick film after drying, said film is then dried to form the charge generating layer.

Next, 5 g of 4-diethylaminobenzaldehyde diphenylhydrazone (DEH) and 5 g of polycarbonate (Teijin Kasei Co., K-1300) are dissolved in 30 g of THF, and the solution is applied over the charge generating layer so as to form a layer of 15 micron thickness after drying, said application is then dried forming a charge transporting layer and an organic photosensitive layer Ap is thus obtained.

An organic photosensitive layer Ad is formed on a cylindrical aluminum substrate measuring 80×330 mm by means of an identical process.

Comparative Example 1

The organic photosensitive layers Ap and Ad obtained by the previously described process were subjected to an initial charge of −600 V using the corona discharge during the normal Carlson process. The measured amount of light required to reduce the surface potential by half (hereinafter referred to as El/2) was 2.0 lux-sec., and the residual potential (hereinafter referred to as Vr) was −5 V. Also, the organic photosensitive layers of the member Ap and Ad had a surface hardness ratings of approximately 5B based on measurements for pencil lead hardness as provided in Japanese Industrial Standards JIS K-5400. When these photosensitive members Ap and Ad were installed in actual copying machines (Minolta Model EP470Z) and subjected to resistance tests comprising the making of 5,000 A4 size observed. From these results, it can be understood that although the organic photosensitive member of the present invention was observed to possess superior electrostatic characteristics, the member was observed to be poor in durability.

Manufacture of Organic Photosensitive Layer B

Organic photosensitive layers Bp and Bd were manufactured in substantially the same manner as were layers Ap and Ad with the exception of substituting methyl methacrylate PMMA (Mitsubishi Rayon Co., Ltd. BR-85) for the polycarbonate used to form the charge transporting layer.

Comparative Example 2

Evaluations of the organic photosensitive layers Bp and Bd were conducted using the same criteria as for Comparative Example 1; the results are shown in Table 1.

From these results, it can be understood that although the organic photosensitive member of the present invention was observed to possess superior electrostatic characteristics, the member was observed to be poor in durability.

Manufacture of Organic Photosensitive Layer C

Organic photosensitive layers Cp and Cd were manufactured in substantially the same manner as were layers Ap and Ad with the exception of substituting polyarylate (Unitika LTD., U-4000) for the polycarbonate used to form the charge transporting layer.

Comparative Example 3

Evaluations of the organic photosensitive layers Cp and Cd were conducted using the same criteria as for Comparative Example 1; the results are shown in Table 1.

From these results, it can be understood that although the organic photosensitive member of the present invention was observed to possess superior electrostatic characteristics, the member was observed to be poor in durability.

Manufacture of Organic Photosensitive Layer D

Organic photosensitive layers Dp and Dd were manufactured in substantially the same manner as were layers Ap and Ad with the exception of substituting polyester (Toyobo Co., LTD., V-200) for the polycarbonate used to form the charge transporting layer.

Comparative Example 4

Evaluations of the organic photosensitive layers Dp and Dd were conducted using the same criteria as for Comparative Example 1; the results are shown in Table 1.

From these results, it can be understood that although the organic photosensitive member of the present invention was observed to possess superior electrostatic characteristics, the member was observed to be poor in durability.

Manufacture of Organic Photosensitive Layer E

A fluid mixture of 25 parts by weight of specific α-type copper phthalocyanine (Toyo Ink Manufacturing Co, LTD.,), 50 parts acrylmelamine thermosetting resin (Dainippon Ink and Chemicals, Inc., a mixture of A-405 and Super Bekkamin J-8200), 25 parts 4-diethylaminobenzaldehyde diphenylhydrazone, and 500 parts organic solvent (a mixture of 7 parts xylene and 3 parts butanol) is pulverized and dispersed in a ball mill for 10 hours. An aluminum plate substrate measuring 50 mm in length, 50 mm in width and 3 mm in thickness dipped in this fluid dispersion so as to be coated with a film having a thickness of 15 microns after drying, said film is then baked 1 hour at 150° C., whereby the organic photosensitive layer Ep is obtained. An organic photosensitive layer Ed is formed on a 80×330 mm cylindrical aluminum substrate by means of an identical process.

Comparative Example 5

Evaluations of the organic photosensitive layers Ep and Ed were conducted using the same criteria as for Comparative Example 1; the results are shown in Table 1.

From these results, it can be understood that although the organic photosensitive member of the present invention was observed to possess superior electrostatic characteristics, the member was observed to be poor in durability.

TABLE 1

| Comparative Example | V0 (V) | $E_{\frac{1}{2}}$ (lux-sec) | Vr (V) | Hardness | Film Loss (μm) |
|---|---|---|---|---|---|
| Ex. 1 | −600 | 2.0 | −5 | 5B | 1.0 |
| Ex. 2 | −600 | 6.2 | −12 | B | 1.0 |
| Ex. 3 | −600 | 2.3 | −8 | 5B | 1.0 |
| Ex. 4 | −600 | 2.2 | −7 | 5B | 1.0 |
| Ex. 5 | +600 | 4.3 | +5 | B | 1.0 |

(Evaluations conducted for layer loss varied with each Example as follows:)
Ex. 1 after 5,000
Ex. 2 after 8,000
Ex. 3 after 4,000
Ex. 4 after 5,000
Ex. 5 after 10,000

Examples 1 to 5

Using a glow discharge decomposition apparatus shown in FIG. 2, an overcoat layer of the present invention for a photosensitive member was prepared.

First, the interior of the reactor 733 was evacuated to a high vacuum of about $10^{-6}$ torr, and the first, second and third regulator valves 707, 708 and 709 were thereafter opened to introduce hydrogen gas from the first tank 701, butadiene gas from the second tank 702 and hydrogen sulfide gas from the third tank 703 into the first flow controller 713, the second flow controller 714 and the third flow controller 715 respectively at an output pressure of 1.0 kg/cm$^2$. The dials on the flow controllers were adjusted to supply the hydrogen gas at a flow rate of 210 sccm, the butadiene gas at 60 sccm and the hydrogen sulfide gas at 10 sccm to the reactor 733 through the main pipe 732 via the intermediate mixer 731. After the flows of the gases were stabilized, the internal pressure of the reactor 733 was adjusted to 0.5 torr by the pressure control valve 745. On the other hand, the organic photosensitive layers Ap (Example 1), Bp (Example 2), Cp (Example 3), Dp (Example 4) and Ep (Example 5) were used as the substrate 752, said substrate being preheated to a temperature of 50° C. for 15 minutes before the introduction of these gases. With the gas flow rates and the pressure in stabilized state, 50-watt power with a frequency of 100 KHz was applied to the power application electrode 736 from the low-frequency power source 741 preconnected thereto by the selecting switch 744 to conduct plasma polymerization for 2 minutes, forming an a-C layer, 0.25 microns in thickness, as an overcoat layer. After completion of the film formation, the power supply was discontinued, the regulator valves except for the one for hydrogen gas were all closed. Then, only the hydrogen gas was introduced into the reactor 733 at a flow rate of 200 sccm with a pressure of 1.0 Torr to decrease the temperature of the substrate to 30° C. for about 15 minutes. Thereafter, the regulator valves for hydrogen gas was closed, whereupon the vacuum was broken and the photosensitive member of the present invention was removed.

When subjected to organic quantitative analysis and Auger electron spectroscopy, the a-C layer thus obtained was found to contain 45 atomic % of hydrogen atoms and 3.7 atomic % of chalcogen atoms, i.e., sulfur atoms based on all the constituent atoms contained therein.

Characteristics:

The overcoat layers obtained in Examples 1 to 5 had a surface hardness of about 6 H based on measurements for pencil lead hardness as provided in Japanese Industrial Standards JIS K-5400, and it is understood that the high degree of surface hardness was a marked improvement.

Further, photosensitivity of the members obtained in each Example is almost the same as shown in Comparative Examples 1 to 5. This indicates that the overcoat layer of the photosensitive member according to the present invention does not impair the inherently superior sensitivity of the organic photosensitive layer.

In addition, the photosensitive members obtained in Examples 1 to 5 were exposed to atmospheric conditions of low temperature-low humidity (10° C. and 30% humidity) and high temperature-high humidity (50° C. and 90% humidity) which were alternated every 30 minutes each over a 6 hour period, and cracking or separation of the overcoat layer was not observed, from which results it is understood that the photosensitive member having the overcoat layer of the present invention has superior adhesive properties regarding its adhesion to the organic photosensitive layers.

Examples 2 to 58

Photosensitive members were prepared as similarly as with Example 1, each member comprising an organic photosensitive layer and an overcoat layer provided in this order as shown in FIG. 1.

Table 2 shows the various condition values for forming an overcoat layer. Table 2 shows the conditions different from Example 1 for forming an overcoat layer and classified into 17 items (1) to (17). These items are described at the top column of the Table. Some condition values shown at each item are common to each example, while others are varying in each example.

Table 2 shows the items (1) to (17) as follows:

(1) flow rate of material gas from the first tank (701) (sccm)

(2) flow rate of material gas from the second tank (702) (sccm)

(3) flow rate of dopant gas from the third tank (703) (sccm)

(4) flow rate of dopant gas from the fourth tank (704) (sccm)

(5) flow rate of dopant gas from the first container (719) (sccm)

(6) temperature of the first heater (722) (° C.)

(7) pressure (Torr)

(8) temperature of the substrate (° C.)

(9) time for heating the substrate (minute)

(10) power (watt)

(11) time for plasma polymerization (minute)

(12) thickness of the layer (micron)

(13) frequency from the power source (KHz)

(14) hydrogen content (atomic %)

(15) and (16) content of dopant contained in the overcoat layer (atomic %)

(17) organic photosensitive layer

Characteristics:

The overcoat layers obtained in Examples 2 to 58 had a surface hardness of about 6 H based on measurements for pencil lead hardness as provided in Japanese Industrial Standards JIS K-5400, and it is understood that the high degree of surface hardness was a marked improvement.

Further, photosensitivity of the members obtained in each Example is almost the same as shown in Comparative Examples 1 to 5. This indicates that the overcoat layer of the photosensitive member according to the present invention does not impair the inherently superior sensitivity of the organic photosensitive layer.

In addition, the photosensitive members obtained in Examples 2 to 58 were exposed to atmospheric conditions of low temperature-low humidity (10° C. and 30% humidity) and high temperature-high humidity (50° C. and 90% humidity) which were alternated every 30 minutes each over a 6 hour period, and cracking or separation of the overcoat layer was not observed, from which results it is understood that the photosensitive member having the overcoat layer of the present invention has superior adhesive properties regarding its adhesion to the organic photosensitive layers.

Further, with regard to Examples 6 to 10, 16 to 20, 26 to 30 and 36 to 40, clear images were obtained when the members obtained in these Examples were installed in a Minolta Model EP 650 Z copy machine and copies made. In addition, so-called image drift was not observed when copies were made under environmental conditions of 35° C. temperature and 80% humidity. Neither was any separation of the overcoat layer noted when said layer came into contact with the developer, copy paper, and cleaning components within the copy machine. Under normal room conditions, 250,000 copies were made and clear images were obtained to the last. From these results, it can be understood that the overcoat layer of the present invention improved the harmful aspects and increased durability while it did not impair image quality.

TABLE 2

| Ex. No. | (1) sccm | (2) sccm | | (3) sccm | | (4) sccm | | (5) sccm | | (6) °C. | (7) Torr | (8) °C. | (9) min | (10) watt | (11) min | (12) μm | (13) KHz | (14) at. % | (15) at. % | | (16) at. % | | (17) |
|---|---|---|---|---|---|---|---|---|---|---|---|---|---|---|---|---|---|---|---|---|---|---|---|
| 6 | | | | | | | | | | | | | | | | | | | | | | | Ad |
| 7 | $H_2$ | | | | | | | | | | | | | | | | | | | | | | Bd |
| 8 | 250 | $C_4H_6$ | 60 | $H_2S$ | 5 | — | — | — | — | — | 2.0 | 50 | 15 | 100 | 1.3 | 0.3 | 50 | 43 | S | 1.1 | — | — | Cd |
| 9 | | | | | | | | | | | | | | | | | | | | | | | Dd |
| 10 | | | | | | | | | | | | | | | | | | | | | | | Ed |
| 11 | | | | | | | | | | | | | | | | | | | | | | | Ap |
| 12 | $H_2$ | | | *1 | | | | | | | | | | | | | | | | | | | Bp |
| 13 | 110 | $C_4H_6$ | 60 | $B_2H_6$ | 100 | — | — | — | — | — | 0.5 | 50 | 15 | 50 | 2 | 0.25 | 100 | 45 | B | 3.2 | — | — | Cp |
| 14 | | | | | | | | | | | | | | | | | | | | | | | Dp |
| 15 | | | | | | | | | | | | | | | | | | | | | | | Ep |
| 16 | | | | | | | | | | | | | | | | | | | | | | | Ad |
| 17 | $H_2$ | | | | | | | | | | | | | | | | | | | | | | Bd |
| 18 | 250 | $C_4H_6$ | 60 | — | — | — | — | $(CH_3)_3$ Al | | 35 | 0.25 | 50 | 15 | 100 | 3 | 0.3 | 50 | 43 | Al | 1.0 | — | — | Cd |
| 19 | | | | | | | | 5 | | | | | | | | | | | | | | | Dd |
| 20 | | | | | | | | | | | | | | | | | | | | | | | Ed |
| 21 | | | | | | | | | | | | | | | | | | | | | | | Ap |
| 22 | $H_2$ | | | *2 | | | | | | | | | | | | | | | | | | | Bp |
| 23 | 110 | $C_4H_6$ | 60 | $SiH_4$ | 100 | — | — | — | — | — | 0.5 | 50 | 15 | 50 | 2 | 0.3 | 100 | 45 | Si | 9.8 | — | — | Cp |
| 24 | | | | | | | | | | | | | | | | | | | | | | | Dp |
| 25 | | | | | | | | | | | | | | | | | | | | | | | Ep |
| 26 | | | | | | | | | | | | | | | | | | | | | | | Ad |
| 27 | $H_2$ | | | *1 | | | | | | | | | | | | | | | | | | | Bd |
| 28 | 250 | $C_4H_6$ | 60 | $GeH_4$ | 50 | — | — | — | — | — | 2.0 | 50 | 15 | 100 | 1 | 0.3 | 50 | 43 | Ge | 5.1 | — | — | Cd |
| 29 | | | | | | | | | | | | | | | | | | | | | | | Dd |
| 30 | | | | | | | | | | | | | | | | | | | | | | | Ed |
| 31 | | | | | | | | | | | | | | | | | | | | | | | Ap |
| 32 | $H_2$ | | | 1* | | | | | | | | | | | | | | | | | | | Bp |
| 33 | 110 | $C_4H_6$ | 60 | $PH_3$ | 100 | — | — | — | — | — | 0.5 | 50 | 15 | 50 | 2 | 0.25 | 100 | 45 | P | 3.8 | — | — | Cp |
| 34 | | | | | | | | | | | | | | | | | | | | | | | Dp |
| 35 | | | | | | | | | | | | | | | | | | | | | | | Ep |
| 36 | | | | | | | | | | | | | | | | | | | | | | | Ad |
| 37 | $H_2$ | | | *1 | | | | | | | | | | | | | | | | | | | Bd |
| 38 | 250 | $C_4H_6$ | 60 | $PH_3$ | 50 | — | — | — | — | — | 2.0 | 50 | 15 | 100 | 1.3 | 0.3 | 50 | 43 | P | 1.1 | — | — | Cd |
| 39 | | | | | | | | | | | | | | | | | | | | | | | Dd |
| 40 | | | | | | | | | | | | | | | | | | | | | | | Ed |
| 41 | | | | | | | | | | | | | | | | | | | | | | | Ap |
| 42 | $H_2$ | | | | | | | | | | | | | | | | | | | | | | Bp |
| 43 | 160 | $C_4H_6$ | 50 | $H_2Se$ | 10 | — | — | — | — | — | 0.6 | 45 | 15 | 60 | 2.25 | 0.25 | 150 | 44.2 | Se | 3.5 | — | — | Cp |
| 44 | | | | | | | | | | | | | | | | | | | | | | | Dp |
| 45 | | | | | | | | | | | | | | | | | | | | | | | Ep |
| 46 | | | | | | | | | | | | | | | | | | | | | | | Ap |
| 47 | $H_2$ | | | | | | | | | | | | | | | | | | | | | | Bp |
| 48 | 110 | $C_4H_6$ | 60 | $Ash_3$ | 100 | — | — | — | — | — | 0.5 | 40 | 15 | 60 | 2.5 | 0.25 | 200 | 43 | As | 5.2 | — | — | Cp |
| 49 | | | | | | | | | | | | | | | | | | | | | | | Dp |
| 50 | | | | | | | | | | | | | | | | | | | | | | | Ep |
| 51 | $H_2$ | *3 | | | | | | | | | | | | | | | | | | | | | Ap |
| | 210 | $C_3H_6$ | 60 | $H_2S$ | 10 | — | — | — | — | — | 0.5 | 50 | 15 | 50 | 2 | 0.2 | 100 | 45 | S | 3.7 | — | — | |
| 52 | $H_2$ | *4 | | | | | | | | | | | | | | | | | | | | | Bp |
| | 210 | $C_3H_6$ | 60 | $H_2S$ | 10 | — | — | — | — | — | 0.5 | 50 | 15 | 50 | 2 | 0.2 | 100 | 45 | S | 3.7 | — | — | |
| 53 | $H_2$ | *5 | | | | | | | | | | | | | | | | | | | | | Cp |
| | 210 | $C_3H_4$ | 60 | $H_2S$ | 10 | — | — | — | — | — | 0.5 | 50 | 15 | 50 | 2 | 0.2 | 100 | 45 | S | 3.7 | — | — | |

TABLE 2-continued

| Ex. No. | (1) sccm | (2) sccm | | (3) sccm | | (4) sccm | | (5) sccm | | (6) °C. | (7) Torr | (8) °C. | (9) min | (10) watt | (11) min | (12) μm | (13) KHz | (14) at. % | | (15) at. % | | (16) at. % | | (17) |
|---|---|---|---|---|---|---|---|---|---|---|---|---|---|---|---|---|---|---|---|---|---|---|---|---|
| 54 | $H_2$ | *3 | | *2 | | *2 | | | | | | | | | | | | | | | | | | Ad |
| | 100 | $C_3H_6$ | 60 | $SiH_4$ | 40 | $PH_3$ | 40 | — | — | — | 0.6 | 45 | 15 | 50 | 2.75 | 0.25 | 400 | 39.5 | Si | 3.3 | P | 2.7 | | |
| 55 | He | | | $H_2S$ | 10 | *2 | | | | | | | | | | | | | | | | | | Bd |
| | 100 | $C_4H_6$ | 60 | | | $SiH_4$ | 100 | — | — | — | 0.7 | 50 | 15 | 45 | 3 | 0.3 | 800 | 38.5 | S | 3.2 | Si | 1 | | |
| 56 | Ar | *5 | | *2 | | | | | | | | | | | | | | | | | | | | Cd |
| | 100 | $C_3H_4$ | 60 | $PH_3$ | 7 | $H_2Se$ | 20 | — | — | — | 0.4 | 55 | 15 | 55 | 1.75 | 0.2 | 150 | 40.7 | P | 0.6 | Se | 7.4 | | |
| 57 | $H_2$ | *4 | | *2 | | | | | | | | | | | | | | | | | | | | Dd |
| | 100 | $C_3H_6$ | 50 | $B_2H_6$ | 60 | $H_2S$ | 15 | — | — | — | 0.5 | 60 | 15 | 60 | 2 | 0.23 | 200 | 42.5 | B | 7.2 | S | 4.9 | | |
| 58 | $H_2$ | *4 | | | | *2 | | | | | | | | | | | | | | | | | | Ed |
| | 100 | $C_3H_6$ | 60 | $H_2Se$ | 20 | $SiH_4$ | 40 | — | — | — | 0.5 | 50 | 15 | 55 | 2.8 | 0.27 | 500 | 43 | Se | 6.7 | Si | 3.7 | | |

[note:]
(1) The gases with a mark *1 are diluted to the concentration of 10% with hydrogen gas.
(2) The gases with a mark *2 are diluted to the concentration of 20% with hydrogen gas.
(3) The gases with a mark *3 mean propene.
(4) The gases with a mark *4 mean cyclopropene.
(5) The gases with a mark *5 mean allene.
(6) $C_4H_6$ in Table 2 means butadiene.
(7) In Examples 2 to 58, after completion of the film formation, the power supply was discontinued, the regulator valves except for the one for hydrogen gas were all closed. Then, only the hydrogen gas was introduced into the reactor 733 at a flow rate of 200 sccm with a pressure of 1.0 Torr to decrease the temperature of the substrate to 30° C. for about 15 minutes.
(8) $(CH_3)_3Al$ at column 5 in Table 2 means trimethyl aluminum gas.

Comparative Examples 6 to 10

Overcoat layers were formed on organic photosensitive layers as per Examples 6 to 10 except for omitting the inflow of hydrogen sulfide gas.

The overcoat layers obtained in Comparative Examples 6 to 10 had a surface hardness of about 4 H based on measurements for pencil lead hardness as provided in Japanese Industrial Standards JIS K-5400, and it is understood that these members had a lower surface hardness compared with those in Examples 6 to 10. This indicates that the addition of chalcogen atoms into the overcoat layer improves the surface hardness thereof.

Subsequently, these photosensitive members were installed in copy machines and continuous copy operations performed. As a result, so-called image drift was produced under environmental conditions of 35° C. temperature and 80% humidity.

After completion of the field tests, the photosensitive members obtained in Comparative Examples 6 to 10 were exposed to atmospheric conditions of low temperature-low humidity (10° C. and 30% humidity) and high temperature-high humidity (50° C. and 90% humidity) which were alternated every 30 minutes each over a six hour period, with the result that the overcoat layers gradually separated from the photosensitive layers.

Comparative Examples 11 to 15

Overcoat layers were formed on organic photosensitive layers as per Examples 16 to 20 except for omitting the inflow of trimethyl aluminum gas [$(CH_3)_3Al$].

The obtained test materials exhibited poor moisture resistance and produced image drift under high temperature conditions prior to use in resistance tests, thus confirming their impracticality.

Comparative Examples 16 to 20

Overcoat layers were formed on organic photosensitive layers as per Examples 26 to 30 except that the germane gas ($GeH_4$) was not introduced and the flow rate of hydrogen gas was increased to 300 sccm.

The obtained test materials exhibited poor moisture resistance and produced image drift under high temperature conditions prior to use in resistance tests, thus confirming their impracticality.

Comparative Examples 21 to 25

Overcoat layers were formed on organic photosensitive layers as per Examples 26 to 30 except that the germane gas ($GeH_4$) which was not diluted by the hydrogen at a flow rate of 150 sccm was introduced and the flow rate of hydrogen gas was decreased to 150 sccm.

When subjected to organic quantitative analysis and Auger electron spectroscopy, the a-C layer thus obtained was found to contain 24 atomic % of hydrogen atoms and 53 atomic % of germanium atoms based on all the constituent atoms contained therein.

Characteristics: 7 When these photosensitive members were installed in copy machines and continuous copy operations performed, photosensitivity was reduced to a half of those in Examples 26 to 30. This indicates that the amount of incident light to the photosensitive layers is decreased due to high light absorption coefficient of the overcoat layer, causing reduced photosensitivity. From this result, it is understood that the addition of excess amount of Group IV atoms is undesirable.

Comparative Examples 26 to 30

Overcoat layers were formed on organic photosensitive layers as per Examples 36 to 40 except that the phosphine gas ($PH_3$) was not introduced and the flow rate of hydrogen gas was increased to 300 sccm.

The obtained test materials exhibited poor moisture resistance and produced image drift under high temperature conditions prior to use in resistance tests, thus confirming their impracticality.

What is claimed is:

1. A photosensitive member comprising:

an electrically conductive substrate;

a photoconductive layer comprising an organic material and having a charge retaining function and a charge transporting function; and an overcoat layer formed on said photoconductive layer and comprising amorphous carbon containing hydrogen, said overcoat layer containing at least one element selected from the group consisting of chalcogen and elements of Group III, IV and V of the periodic table, said overcoat layer having a thickness of from about 0.01 to about 5 microns and being formed by plasma polymerization.

2. A photosensitive member as claimed in claim 1 wherein the amount of the hydrogen contained in the overcoat layer is about 30 to about 60 atomic % based on the combined amount of hydrogen and carbon therein.

3. A photosensitive member as claimed in claim 1 wherein the amount of the chalcogen contained in the overcoat layer is about 0.1 to about 20 atomic % based on all the constituent atoms therein.

4. A photosensitive member as claimed in claim 3 wherein the amount of the chalcogen contained in the overcoat layer is preferably about 0.5 to about 20 atomic % based on all the constituent atoms therein.

5. A photosensitive member as claimed in claim 1 wherein the amount of the elements in Group III of the periodic table contained in the overcoat layer is about 0.1 to about 20 atomic % based on all the constituent atoms therein.

6. A photosensitive member as claimed in claim 5 wherein the amount of the elements in Group III of the periodic table contained in the overcoat layer is preferably about 0.5 to about 20 atomic % based on all the constituent atoms therein.

7. A photosensitive member as claimed in claim 1 wherein the amount of the elements in Group IV of the periodic table contained in the overcoat layer is about 0.1 to about 50 atomic % based on all the constituent atoms therein.

8. A photosensitive member as claimed in claim 7 wherein the amount of the elements in Group IV of the periodic table contained in the overcoat layer is preferably about 1.0 to about 20 atomic % based on all the constituent atoms therein.

9. A photosensitive member as claimed in claim 1 wherein the amount of the elements in Group V of the periodic table contained in the overcoat layer is about 0.1 to about 20 atomic % based on all the constituent atoms therein.

10. A photosensitive member as claimed in claim 9 wherein the amount of the elements in Group V of the periodic table contained in the overcoat layer is preferably about 0.5 to about 20 atomic % based on all the constituent atoms therein.

11. A process for preparing a photosensitive member comprising:

a first step of forming a photoconductive layer on an electrically conductive substrate, said photoconductive layer comprising an organic material and having a charge retaining function and a charge transporting function;

a second step of heating the substrate on which the photoconductive layer is formed to a temperature not exceeding 100° C.;

a third step of introducing gaseous material containing at least chalcogen atoms, elements in Group III, IV and V of the periodic table into a reaction chamber; and a fourth step of applying electric power to cause glow discharge in the reaction chamber to thereby form an overcoat layer on the photoconductive layer, said overcoat layer comprising amorphous carbon containing hydrogen, and said overcoat layer containing at least one element selected from the group consisting of chalcogen and elements in Group III, IV and V of the periodic table, said overcoat layer having a thickness of from about 0.01 to about 5 microns and being formed by plasma polymerization.

* * * * *